US008871020B2

(12) United States Patent
Lambrechts

(10) Patent No.: US 8,871,020 B2
(45) Date of Patent: Oct. 28, 2014

(54) HIGH ELONGATION FIBRES

(75) Inventor: Ann Lambrechts, Avelgem (BE)

(73) Assignee: NV Bekaert SA, Zwevegem (BE)

( * ) Notice: Subject to any disclaimer, the term of this patent is extended or adjusted under 35 U.S.C. 154(b) by 299 days.

(21) Appl. No.: 13/377,288

(22) PCT Filed: Jun. 14, 2010

(86) PCT No.: PCT/EP2010/058292

§ 371 (c)(1),
(2), (4) Date: Dec. 9, 2011

(87) PCT Pub. No.: WO2010/142807

PCT Pub. Date: Dec. 16, 2010

(65) Prior Publication Data

US 2012/0090507 A1 Apr. 19, 2012

(30) Foreign Application Priority Data

Jun. 12, 2009 (EP) ..... 09162570

(51) Int. Cl.
*C04B 14/38* (2006.01)
*E04C 5/01* (2006.01)

(52) U.S. Cl.
CPC ..... *E04C 5/012* (2013.01)
USPC ..... 106/644

(58) Field of Classification Search
CPC ..... E04C 5/012; C04B 14/38; C04B 20/0048
USPC ..... 106/644; 428/544, 600, 603
See application file for complete search history.

(56) References Cited

U.S. PATENT DOCUMENTS

| | | | | |
|---|---|---|---|---|
| 2,677,955 | A | 5/1954 | Constantinesco | |
| 3,852,930 | A | 12/1974 | Naaman | |
| 3,900,667 | A | 8/1975 | Moens | |
| 3,942,955 | A | 3/1976 | Moens | |
| 3,953,953 | A * | 5/1976 | Marsden | 428/603 |
| 4,159,911 | A * | 7/1979 | Takazuka | 106/644 |
| 4,224,377 | A | 9/1980 | Moens | |
| 4,233,364 | A | 11/1980 | Van Thiel | |
| 4,284,667 | A | 8/1981 | Moens | |
| 4,298,660 | A * | 11/1981 | Nakagawa | 428/599 |
| 4,513,040 | A * | 4/1985 | Lankard | 428/49 |
| 4,559,276 | A * | 12/1985 | Tezuka | 428/599 |

(Continued)

FOREIGN PATENT DOCUMENTS

| | | |
|---|---|---|
| DE | 92 07 598.3 U1 | 10/1992 |
| DE | 43 15 270 A1 | 11/1993 |

(Continued)

OTHER PUBLICATIONS

Verband Deutscher Stahlfaserhersteller E. V., Stahlfaserbeton—Stahlfasertypen, Jun. 23, 2006, pp. 1-4.

(Continued)

*Primary Examiner* — Paul Marcantoni
(74) *Attorney, Agent, or Firm* — Foley & Lardner LLP

(57) ABSTRACT

The invention relates to a steel fiber for reinforcing concrete or mortar. The fiber has a middle portion and two ends. The middle portion has a ensile strength of at least 1000 N and an elongation at maximum load $A_{g+e}$ of at least 2.5%. The invention further relates to a concrete structure comprising such steel fibers.

12 Claims, 3 Drawing Sheets

(56) References Cited

U.S. PATENT DOCUMENTS

| | | | | | |
|---|---|---|---|---|---|
| 4,560,622 | A | * | 12/1985 | Tezuka et al. | 428/599 |
| 4,585,487 | A | * | 4/1986 | Destree et al. | 106/644 |
| 4,764,488 | A | | 8/1988 | Saito et al. | |
| 4,804,585 | A | * | 2/1989 | Tani et al. | 428/574 |
| 4,883,713 | A | | 11/1989 | Destree et al. | |
| 4,960,649 | A | * | 10/1990 | Takata et al. | 428/574 |
| 5,215,830 | A | * | 6/1993 | Cinti | 428/606 |
| 5,359,873 | A | | 11/1994 | Grondziel | |
| 5,443,918 | A | | 8/1995 | Banthia et al. | |
| 5,503,670 | A | * | 4/1996 | Richard et al. | 106/643 |
| 5,858,082 | A | * | 1/1999 | Cruz et al. | 106/644 |
| 5,965,277 | A | * | 10/1999 | Banthia et al. | 428/574 |
| 6,045,910 | A | | 4/2000 | Lambrechts | |
| 6,235,108 | B1 | * | 5/2001 | Lambrechts | 106/644 |
| 6,887,309 | B2 | * | 5/2005 | Casanova et al. | 106/644 |
| 2002/0177003 | A1 | * | 11/2002 | Myrick | 428/469 |
| 2011/0212343 | A1 | | 9/2011 | Stahl | |
| 2012/0090507 | A1 | | 4/2012 | Lambrechts | |
| 2012/0097073 | A1 | * | 4/2012 | Lambrechts | 106/644 |
| 2013/0255540 | A1 | * | 10/2013 | Lambrechts et al. | 106/644 |
| 2013/0269572 | A1 | * | 10/2013 | Lambrechts et al. | 106/638 |

FOREIGN PATENT DOCUMENTS

| | | | |
|---|---|---|---|
| DE | 42 2 3804 | A1 | 1/1994 |
| DE | 10 2008 034 250 | A1 | 1/2010 |
| EP | 0 582 905 | A2 | 2/1994 |
| EP | 0 851 957 | B1 | 5/2000 |
| EP | 1 282 751 | B1 | 9/2006 |
| EP | 1 383 634 | B1 | 10/2006 |
| EP | 1 790 792 | A2 | 5/2007 |
| EP | 1 840 291 | A2 | 10/2007 |
| JP | 6-294017 | | 10/1994 |
| WO | WO 84/02732 | A1 | 7/1984 |
| WO | WO 93/23343 | A1 | 11/1993 |
| WO | WO 99/55980 | A1 | 11/1999 |
| WO | WO 2010/078995 | A1 | 7/2010 |

OTHER PUBLICATIONS

Ravindra K. Dhir, Composite Materials in Concrete Constructions, 2002, 4 pages.

U.S. Appl. No. 13/377,326, filed Dec. 9, 2011, Lambrechts.

USPTO Office Action, U.S. Appl. No. 13/377,326, Feb. 4, 2014, 6 pages.

USPTO Office Action, U.S. Appl. No. 13/377,326, May 28, 2014, 20 pages.

USPTO Office Action, U.S. Appl. No. 13/993,894, May 28, 2014, 16 pages.

* cited by examiner

HIGH ELONGATION FIBRES

TECHNICAL FIELD

This invention relates to a new type of steel fibre adapted for reinforcing mortar or concrete and in particular for reinforcing conventional concrete.

The steel fibres are characterized by a high elongation.

The invention also relates to a structure of conventional concrete reinforced with this type of steel fibres.

Furthermore, the invention relates to the use of this type of steel fibres for reinforcement of conventional concrete, reinforced, pre-stressed or post-tensioned concrete.

BACKGROUND ART

It is well-known to reinforce concrete or mortar with steel fibres to improve the quality of the concrete or mortar. Steel fibres are for example used to reinforce conventional concrete.

The term "conventional concrete" refers to a concrete having a compression strength lower than 75 MPa (1 MPa=1 Mega-Pascal=1 Newton/mm$^2$), e.g. lower than 70 MPa, and preferably lower than 60 MPa.

EP-B1-851957 (NV Bekaert SA) teaches a steel fibre with flattened hook-shaped ends, whereby the post-crack bending strength of the concrete, reinforced by means of such fibres, is highly improved.

U.S. Pat. No. 4,883,713 (Eurosteel) teaches a steel fibre comprising a cylindrical steel body having conically shaped ends for improving the anchoring feature of the steel fibre into the steel fibre reinforced concrete.

These two cited documents, as well as other documents, already teach that the properties of conventional steel fibre concrete can be highly improved thanks to the improved anchoring features of the steel fibres into the concrete.

Currently the known prior art steel fibres for concrete reinforcement function very well for improving the service-ability limit state (SLS) of a concrete structure, i.e. they bridge very well the cracks or crack mouth opening displacements (CMOD) lower than or equal to 0.5 mm, e.g. CMOD's ranging between 0.1 mm and 0.3 mm, during a typical three point bending test—for the test see European Standard EN 14651—Test method for metallic fibred concrete, measuring the flexural tensile strength. In other words, known steel fibres like steel fibres with flattened hook-shaped ends and fibres having conically shaped ends function well for limiting the width or growth of cracks up to about 0.5 mm (SLS). The disadvantage today with these fibres is their relatively low performance at ultimate state (ULS). Especially, the ratio between ultimate limit state (ULS) and service-ability limit state (SLS) post-crack strength is relatively low. This ratio is determined by the load value $F_{R,1}$ (CMOD=0.5 mm) and $F_{R,4}$ (CMOD=3.5 mm).

Some prior art fibres do not perform at ULS as they break at CMOD lower than what is required for ULS. Other fibres, like fibres with hook shaped ends are designed to be pulled-out. Due to the pull-out, those fibres show a displacement-softening behaviour already for small displacements.

In spite of this low performance at ULS, presently known steel fibres may also be used in so-called structural applications in order to improve the ultimate limit state (ULS). Here the known steel fibres are expected to bear or carry load, instead of or in addition to classical reinforcement, such as rebar, mesh, pre-stressing, and post-tensioning. In order to be effective in such load carrying function, however, these present steel fibres have to be used in huge dosages considerably exceeding normal dosages of 20 kg/m$^3$ to 40 kg/m$^3$. The huge dosages can cause workability problems such as the mixing and placing problems.

DISCLOSURE OF INVENTION

It is an object of the present invention to provide a new type of steel fibres able to fulfil a new function once embedded in concrete or mortar and in particular in conventional concrete.

It is an object of the present invention to provide a new type of steel fibre, which is capable of bridging permanently the crack mouth opening displacements greater than 0.5 mm during the three point bending test according to the European Standard EN 14651 (June 2005).

It is another object of the present invention to provide a new type of steel fibres which are taking loads in structural applications without requiring high dosages.

According to a first aspect of the present invention a steel fibre adapted for reinforcing concrete or mortar and in particular conventional concrete is provided. The steel fibre has a middle portion and two ends, i.e. a first end at one side of the middle portion and a second end at the other end of the middle portion.

The middle portion has a tensile strength $R_m$ (in MPa) of at least 1000 MPa.

Furthermore the steel fibre according to the present invention and more particularly the middle portion of the steel fibre according to the present invention has an elongation at maximum load $A_g$+e that is at least 2.5%.

Elongation at Maximum Load

Within the context of the present invention, the elongation at maximum load $A_{g+e}$ and not the elongation at fracture $A_t$ is used to characterise the elongation of a steel fibre, more particularly of the middle portion of a steel fibre.

The reason is that once the maximum load has been reached, constriction of the available surface of the steel fibre starts and higher loads are not taken up.

The elongation at maximum load $A_{g+e}$ is the sum of the plastic elongation at maximum load $A_g$ and the elastic elongation.

The elongation at maximum load does not comprise the structural elongation $A_s$ which may be due to the wavy character of the middle portion of the steel fibre (if any). In case of a wavy steel fibre, the steel fibre is first straightened before the $A_{g+e}$ is measured.

The elongation at maximum load $A_{g+e}$ of the middle portion of a steel fibre according to the present invention is at least 2.5%.

According to particular embodiments of the present invention, the middle portion of the steel fibre has an elongation at maximum load $A_{g+e}$ higher than 2.75%, higher than 3.0%, higher than 3.25%, higher than 3.5%, higher than 3.75%, higher than 4.0%, higher than 4.25%, higher than 4.5%, higher than 4.75%, higher than 5.0%, higher than 5.25%, higher than 5.5%, higher than 5.75% or even higher than 6.0%.

The high degree of elongation at maximum load $A_{g+e}$ may be obtained by applying a particular stress-relieving treatment such as a thermal treatment to the steel wires where the steel fibres will be made of.

Conventional steel fibres are made from wire with relatively small elongation at maximum load $A_{g+e}$ (elongation at maximum load $A_{g+e}$ of max. 2%). Thus conventional steel fibres in conventional concrete are designed to be pulled-out of the matrix (fibres with hook shaped ends). Other steel fibres known in the art do not perform at ULS as they break at CMOD lower than what is required for ULS. Examples of such steel fibres are steel fibres with conically shaped ends.

Fibres according to this invention elongate due to the steel wire with high elongation at maximum load $A_{g+e}$. They elongate and do not break before reaching ULS. Furthermore as the fibres according to the present invention have a high tensile strength concrete reinforced with this type of steel fibres may withstand high loads.

The high elongation values of the wire at maximum load must allow to bridge the crack mouth opening displacements greater than 0.5 mm and must allow to take up loads instead of traditional reinforcement or in addition to traditional reinforcement at normal levels of dosage. So the new type of steel fibre improves the ultimate limit state (ULS) of concrete structures. The new fibres not only improve the durability but also improve the bearing or load capacity.

Tensile Strength $R_m$

A steel fibre according to the present invention, i.e. the middle portion of a steel fibre according to the present invention preferably has a high tensile strength $R_m$. The tensile strength $R_m$ is the greatest stress that the steel fibre withstands during a tensile test.

The tensile strength $R_m$ of the middle portion of the steel fibre (i.e. the maximum load capacity $F_m$ divided by the original cross-section area of the steel fibre) is preferably above 1000 MPa, and more particularly above 1400 MPa, e.g. above 1500 MPa, e.g. above 1750 MPa, e.g. above 2000 MPa, e.g. above 2500 MPa.

The high tensile strength of steel fibres according to the present invention allows the steel fibres to withstand high loads.

A higher tensile strength is thus directly reflected in a lower dosage of the fibres, necessary in conventional concrete.

Because of the high ductility or high elongation of the steel fibres according to the present invention, the fibres will not break at CMOD's above 1.5 mm, above 2.5 mm or above 3.5 mm in the three point bending test according to EN 14651.

The high ductility or elongation of the steel fibre allows that cracks with wider openings may be bridged and that the post-crack strength of concrete after the occurrence of cracks, will be increased with increasing crack width. Or once the concrete is cracked, the fibre reinforced concrete shows a bending stiffening behaviour.

In a preferred embodiment the steel fibre comprises a middle portion and anchorage ends for anchoring the steel fibre in the concrete or mortar. In such preferred embodiment the anchorage force of the steel fibre in the concrete or mortar is preferably higher than 50% of the maximum load capacity $F_m$ of the middle portion of the steel fibre. The anchorage force is determined by the maximum load that is reached during a pull out test. For this pull out test a steel fibre is embedded with one end in the concrete or mortar. The test is described further in more detail.

According to preferred embodiments of the invention, the steel fibres have a higher anchorage force, for example an anchorage force higher than 60%, higher than 70% or higher than 80% of the maximum load capacity $F_m$.

More preferably the anchorage force of the steel fibre in the concrete or mortar is even higher than 90%, for example higher than 92%, 95%, 98% or even higher than 99%.

The higher degree of anchorage of the steel fibres in the concrete or mortar, the higher the residual strength of the concrete or more. The better the steel fibres are prevented from slipping out of the concrete, the better the full strength of the middle portion of the steel fibre is used. For example in case the anchorage force of the steel fibre in the concrete or mortar is 90%; 90% of the full strength of the middle portion of the steel fibre may be used.

The high degree of anchorage in concrete can be obtained in different ways as for example by thickening or enlarging the ends, by cold heading, by flattening the steel fibres, by making pronounced hooks to the ends of the steel fibres, by undulating the ends or by combinations thereof. The anchorage ends are for example thickened anchorage ends, enlarged anchorage ends, cold headed anchorage ends, flattened anchorage ends, bent anchorages ends, undulated anchorage ends or any combination thereof.

The mechanism why some ends provide a better anchorage than others is not fully understood and the degree of anchorage can not be predicted by for example mathematical modelling. Therefore, according to the present invention it is proposed to determine the anchorage force of a steel fibre by embedding the steel fibre provided with one end in concrete or mortar and by subjecting the steel fibre to a pull out test (load displacement test).

The steel fibres, more particularly the middle portion of the steel fibers typically have a diameter D ranging from 0.10 mm to 1.20 mm. In case the cross-section of the steel fibre and more particularly of the middle portion of the steel fibre is not round, the diameter is equal to the diameter of a circle with the same surface area as the cross-section of the middle portion of the steel fibre.

The steel fibres; more particularly the middle portion of the steel fibers typically have a length to diameter ratio L/D ranging from 40 to 100.

The middle portion of the steel fibre are can be straight or rectilinear; or can be wavy or undulated.

According to a second aspect of the present invention, there is provided a concrete structure comprising steel fibres according to the present invention. The concrete structure comprises for example conventional concrete.

The concrete structure has an average post crack residual strength at ULS exceeding 3 MPa, e.g. more than 4 MPa, e.g. more than 5 MPa, 6 MPa, 7 MPa, 7.5 MPa.

The dosage of steel fibres in the concrete structure is preferably but not necessarily less than 80 kg/m$^3$, preferably less than 60 kg/m$^3$. The dosage of steel fibres in concrete may range from typically from 20 kg/m$^3$ to 50 kg/m$^3$, e.g. from 30 kg/m$^3$ to 40 kg/m$^3$.

According to a third aspect of the present invention, the use of steel fibres as described above for load carrying structures of concrete is provided. In particular the invention relates to the use of the new type of steel fibres in a structure of conventional concrete, reinforced, pre-stressed or post-tensioned concrete.

BRIEF DESCRIPTION OF FIGURES IN THE DRAWINGS

The invention will be further explained in the following description by means of the accompanying drawing, wherein.

Figure 4A:
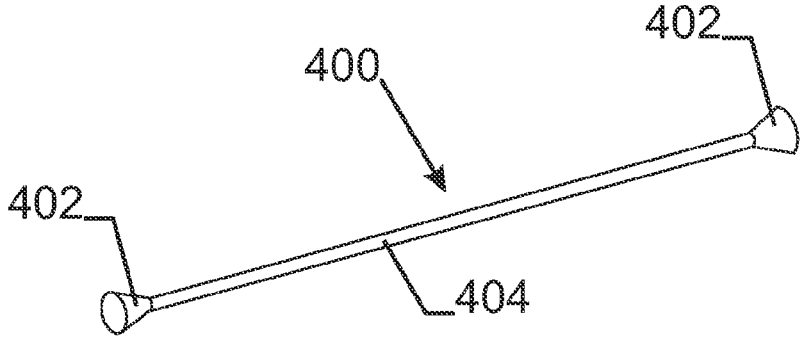
Figure 4B:
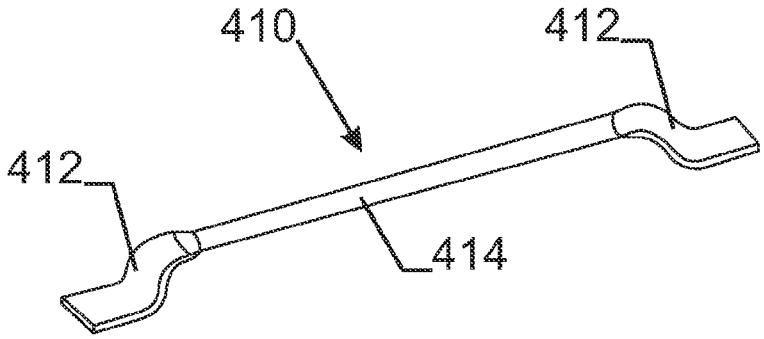
Figure 4C:
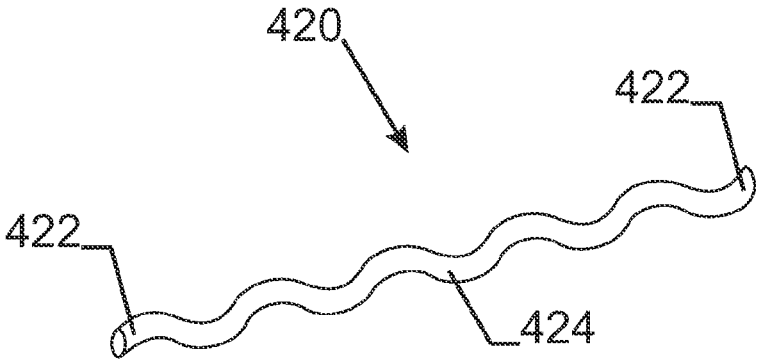

FIG. 4*a*, FIG. 4*b* and FIG. 4*c* are illustrations of steel fibres according to the present invention.

MODE(S) FOR CARRYING OUT THE INVENTION

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

The following terms are provided solely to aid in the understanding of the inventions.

Maximum load capacity ($F_m$): the greatest load which the steel fibre withstands during a tensile test;

Elongation a maximum load (%): increase in the gauge length of the steel fibre at maximum force, expressed as a percentage of the original gauge length;

Elongation at fracture (%): increase in the gauge length at the moment of fracture expressed as a percentage of the original gauge length;

Tensile strength ($R_m$): stress corresponding to the maximum load ($F_m$);

Stress: force divided by the original cross-sectional area of the steel fibre;

Dosage: quantity of fibres added to a volume of concrete (expressed in kg/m$^3$).

To illustrate the invention a number of different steel fibres, prior art steel fibres and steel fibres according to the present invention are subjected to a number of different tests:

a tensile test (load-strain test); and a pull-out test (load-displacement test).

The tensile test is applied on the steel fibre, more particularly on the middle portion of the steel fibre. Alternatively, the tensile test is applied on the wire used to make the steel fibre.

The tensile test is used to determine the maximum load capacity $F_m$ of the steel fibre and to determine the elongation at maximum load $A_{g+e}$.

The pull-out test is applied on the steel fibre embedded with one end in the concrete or mortar. The pull out test is used to measure the anchorage force of a steel fibre in concrete or mortar and can furthermore be used to determine the absolute displacement of the steel fibre embedded in the concrete or mortar.

Figure 1:
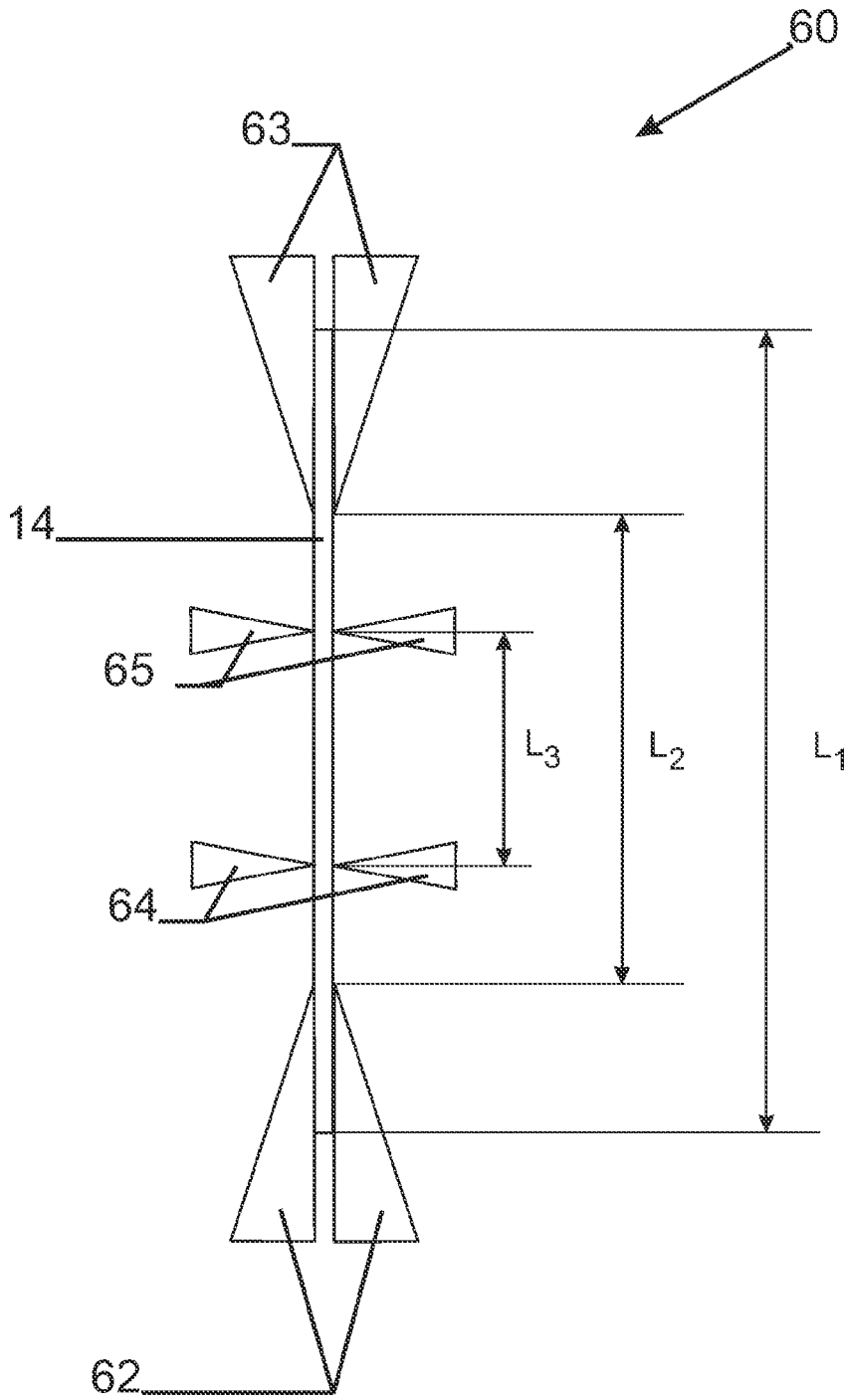
FIG. 1 illustrates a tensile test (load-strain test) of a steel fibre.
Figure 2:
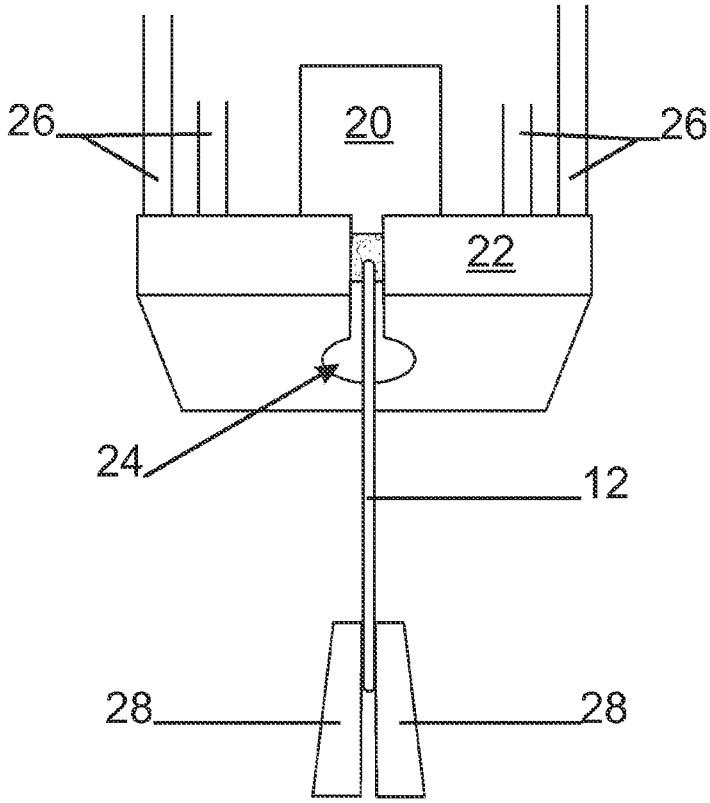
FIG. 2 illustrates a pull-out test (load-displacement test) of a steel fibre embedded in concrete or mortar.

The tests are illustrated in FIG. 1 and FIG. 2 respectively.

FIG. 1 shows a test set up 60 for measuring the elongation of steel fibres adapted for concrete reinforcement. The anchorage ends (for example the enlarged or hook shaped ends) of the steel fibre to be tested are cut first. The remaining middle portion 14 of the steel fibre is fixed between two pairs of clamps 62, 63. Through the clamps 62, 63 an increasing tensile force F is exercised on the middle portion 14 of the steel fibre. The displacement or elongation as a result of this increasing tensile force F is measured by measuring the displacement of the grips 64, 65 of the extensometer. $L_1$ is the length of the middle part of the steel fibre and is e.g. 50 mm, 60 mm or 70 mm. $L_2$ is the distance between the clamps and is e.g. 20 mm or 25 mm. $L_3$ is the extensometer gauge length and is minimum 10 mm, e.g. 12 mm, e.g. 15 mm. For an improved grip of the extensometer to the middle portion 14 of the steel fibre, the middle portion 14 of the steel fibre can be coated or can be covered with a thin tape to avoid slippery of the extensometer over the steel fibre. By this test a load-elongation curve is recorded.

The percentage total elongation at maximum load is calculated by the following formula:

$$A_{g+e} = \frac{\text{extension at maximum load}}{\text{extensometer gauge length } L_3} \times 100$$

With the help of the test set up 60, the invention steel fibre has been compared with a number of commercially available prior art steel fibres as to breaking load $F_m$, tensile strength $R_m$ and total elongation at maximum load $A_{g+e}$. Five tests per specimen have been done. Table 1 summarizes the results.

TABLE 1

| Fibre type | Diameter (mm) | $F_m$ (N) | $R_m$ (MPa) | $A_{g+e}$ (%) |
|---|---|---|---|---|
| Prior art 1 | 0.90 | 879 ± 8 | 1382 ± 12 | 1.37 ± 0.07 |
| Prior art 2 | 1.0 | 911 ± 14 | 1160 ± 18 | 1.86 ± 0.24 |
| Prior art 3 | 1.0 | 1509 ± 12 | 1922 ± 15 | 2.36 ± 0.19 |
| Prior art 4 | 1.0 | 873 ± 10 | 1111 ± 13 | 1.95 ± 0.21 |
| Prior art 5 | 1.0 | 1548 ± 15 | 1972 ± 19 | 1.99 ± 0.27 |
| Prior art 6 | 1.0 | 1548 ± 45 | 1971 ± 58 | 2.33 ± 0.29 |
| Prior art 7 | 0.75 | 533 ± 19 | 1206 ± 43 | 2.20 ± 0.24 |
| Prior art 8 | 0.9 | 751 ± 29 | 1181 ± 46 | 2.16 ± 0.13 |
| Prior art 9 | 0.77 | 1051 ± 20 | 2562 ± 44 | 1.88 ± 0.15 |
| Invention fibre | 0.89 | 1442 ± 3 | 2318 ± 4 | 5.06 ± 0.32 |

Only the invention fibre has an elongation at maximum load exceeding 2.5%.

FIG. 2 illustrates a test set up for measuring the anchorage of a steel fibre in concrete. A steel fibre 12 is anchored at its one end in a concrete cube 20. The cube 20 is made of a conventional concrete. The concrete cube 20 rests on a platform 22 with a central hole 24 through which the steel fibre 12 extends. The platform 22 is held by bars 26 which build a cage around the cube 20. The other end of the steel fibre 12 is cut away and is fixed in clamps 28. A displacement is exercised by clamps 28 on the steel fibre 12 until steel fibre 12 breaks or is pulled out of the cube 20. A force displacement or load displacement diagram is recorded.

Figure 3:
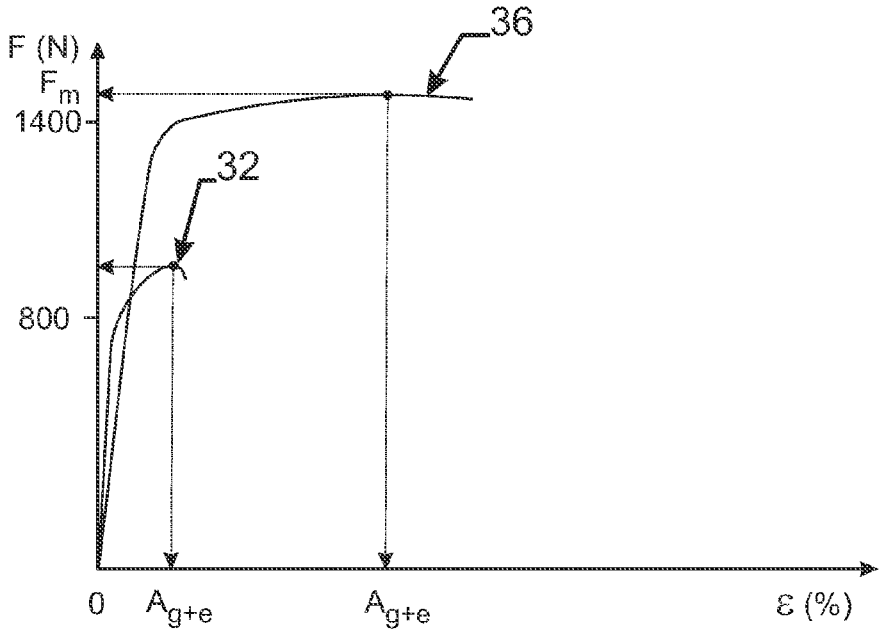
FIG. 3 shows the load-strain curve of a prior art steel fibre and a steel fibre according to the present invention.

FIG. 3*a* shows a load-strain curve of the prior art steel fibre 32 and the steel fibre according to the present invention 36.

The load-strain curves are obtained by subjecting the steel fibres to a test as described in FIG. 1.

The prior art steel fibre has a maximum load $F_m$ somewhat above 800 Newton. This maximum load $F_m$ is equivalent to a tensile strength $R_m$ of about 1200 MPa. The elongation at maximum load $A_{g+e}$ of the prior art steel fibre is relative low, in particular lower than 2.0%.

When the load-strain curve 36 of a steel fibre according to the present invention is compared with the load-strain curves 32 of the prior art steel fibres two differences are to be noticed:

First of all, the maximum load $F_m$ is greater than 1400 Newton, i.e. much greater than the maximum load $F_m$ of the prior art fibre of curve 32. Secondly, the elongation at maximum load $A_{g+e}$ is also much greater than the elongation at maximum load $A_{g+e}$ of the prior art fibre of curve 32. The elongation at maximum load $A_{g+e}$ of the steel fibre according to the present invention is greater than 2.5%, or even greater than 3.0% or 4.0%.

FIG. 4*a*, FIG. 4*b* and FIG. 4*c* show embodiments of steel fibres according to the present invention.

FIG. 4*a* shows a steel fibre 400 having a middle portion 404 and two anchorage ends 402. The anchorage ends 402 are enlarged ends. The middle portion 404 between the two anchorage ends 402 is for example straight or rectilinear. The cross-section of the middle portion 404 is for example substantially circular or round. The diameter or thickness of the middle portion 404 preferably ranges between 0.4 to 1.2 mm.

The length to diameter ratio of the middle portion 404 is, for practical and economical reasons, mostly situated between 40 and 100.

The anchorage ends 402 are enlarged ends that are substantially conically formed for improving the anchoring of the steel fibre 400 into the matrix-material of the concrete, to be reinforced.

FIG. 4*b* shows another steel fibre 410 having a middle portion 414 and two ends 412. The middle portion 414 is straight. The cross-section of the middle portion 414 may be round or slightly flattened. The two anchorage ends 412 are enlarged ends, more particularly enlarged ends that are hooked shaped and possibly also flattened according to the cited EP-B1-851957.

FIG. 4*c* shows a further embodiment of a steel fibre 420 according to the present invention having a middle portion 424 and two anchorage ends 422. The middle portion 424 is undulated. The anchorage ends 422 are also undulated. The undulation of the middle portion 424 and of the anchorage ends 422 can be the same or different.

Steel fibres 400, 410 and 420 preferably have a tensile strength between 1000 and 3000 MPa, most preferably between 1400 MPa and 3000 MPa, e.g. between 1600 MPa and 3000 MPa.

Steel fibres according to the invention may be made as follows. Starting material is a wire rod with a diameter of e.g. 5.5 mm or 6.5 mm and a steel composition having a minimum carbon content of 0.50 per cent by weight (wt %), e.g. equal to or more than 0.60 wt %, a manganese content ranging from 0.20 wt % to 0.80 wt %, a silicon content ranging from 0.10 wt % to 0.40 wt %. The sulphur content is maximum 0.04 wt % and the phosphorous content is maximum 0.04 wt %.

A typical steel composition comprises 0.725% carbon, 0.550% manganese, 0.250% silicon, 0.015% sulphur and 0.015% phosphorus. An alternative steel composition comprises 0.825% carbon, 0.520% manganese, 0.230% silicon, 0.008% sulphur and 0.010% phosphorus. The wire rod is cold drawn in a number of drawing steps until its final diameter ranging from 0.20 mm to 1.20 mm.

In order to give the steel fibre its high elongation at fracture and at maximum load, the thus drawn wire may be subjected to a stress-relieving treatment, e.g. by passing the wire through a high-frequency or mid-frequency induction coil of a length that is adapted to the speed of the passing wire. It has been observed that a thermal treatment at a temperature of about 300° C. for a certain period of time results in a reduction of the tensile strength of about 10% without increasing the elongation at fracture and the elongation at maximum load. By slightly increasing the temperature, however, to more than 400° C., a further decrease of the tensile strength is observed and at the same time an increase in the elongation at fracture and an increase in the elongation at maximum load.

The wires may or may not be coated with a corrosion resistant coating such as a zinc or a zinc alloy coating, more particularly a zinc aluminium coating or a zinc aluminium magnesium coating. Prior to drawing or during drawing the wires may also be coated with a copper or copper alloy coating in order to facilitate the drawing operation.

The stress-relieved wires are then cut to the appropriate lengths of the steel fibres and the ends of the steel fibres are given the appropriate anchorage. Cutting and hook-shaping can also be done in one and the same operation step by means of appropriate rolls.

The thus obtained steel fibres may or may not be glued together according to U.S. Pat. No. 4,284,667.

In addition or alternatively, the obtained steel fibres may be put in a chain package according to EP-B1-1383634 or in a belt like package such as disclosed in European patent application with application number 09150267.4 of Applicant.

The invention claimed is:

1. A steel fibre for reinforcing concrete or mortar, the steel fibre having a middle portion and two ends, the middle portion of the steel fibre having a tensile strength $R_m$ being at least 1000 MPa and an elongation at maximum load $A_{g+e}$ being at least 2.5%.

2. A steel fibre according to claim 1, wherein the middle portion of the steel fibre has a tensile strength $R_m$ of at least 1400 MPa.

3. A steel fibre according to claim 1, wherein the middle portion of the steel fibre has a tensile strength $R_m$ of at least 2000 MPa.

4. A steel fibre according to claim 1, wherein the middle portion of the steel fibre has an elongation at maximum load $A_{g+e}$ of at least 4%.

5. A steel fibre according to claim 1, wherein the middle portion of the steel fibre has an elongation at maximum load $A_{g+e}$ of at least 6%.

6. A steel fibre according to claim 2, wherein the middle portion of the steel fibre has a tensile strength $R_m$ of at least 1400 MPa and an elongation at maximum load $A_{g+e}$ of at least 4%.

7. A steel fibre according to claim 1, wherein the ends are configured as anchorage ends for anchoring the steel fibre in the concrete or mortar.

8. A steel fibre according to claim 7, wherein the anchorage ends are thickened anchorage ends, enlarged anchorage ends, cold headed anchorage ends, flattened anchorage ends, bent anchorages ends, undulated anchorage ends or combination thereof.

9. A steel fibre according to claim 1, wherein the steel fibre is in a stress-relieved state.

10. A steel fibre according to claim 1, wherein the middle portion of the steel fibre has a diameter ranging from 0.1 mm to 1.20 mm.

11. A steel fibre according to claim 1, wherein the middle portion of the steel fibre has a length to diameter ratio L/D ranging from 40 to 100.

12. A steel fibre according to claim 2, wherein the middle portion of the steel fibre has a tensile strength of at least 2000 MPa.

* * * * *